US009038401B2

(12) United States Patent
Johansson et al.

(10) Patent No.: US 9,038,401 B2
(45) Date of Patent: May 26, 2015

(54) BEVERAGE COOLER, A REFRIGERATOR COMPRISING SUCH A BEVERAGE COOLER AND A METHOD FOR COOLING BEVERAGE

(75) Inventors: Daniel L. Johansson, Enebyberg (SE); Ilan Cohen, Alvsjo (SE); Susanne Hedblom, Valbo (SE); Urban Wahlby, Osterskar (SE); Richard Furberg, Akersberga (SE)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 628 days.

(21) Appl. No.: 13/120,774

(22) PCT Filed: Sep. 23, 2009

(86) PCT No.: PCT/EP2009/006865

§ 371 (c)(1), (2), (4) Date: Sep. 2, 2011

(87) PCT Pub. No.: WO2010/034478

PCT Pub. Date: Apr. 1, 2010

(65) Prior Publication Data

US 2011/0308260 A1 Dec. 22, 2011

(30) Foreign Application Priority Data

Sep. 26, 2008 (WO) ..... PCT/EP2008/008215

(51) Int. Cl.

| | |
|---|---|
| ***F25C 1/00*** | (2006.01) |
| ***F25D 31/00*** | (2006.01) |
| ***F25D 23/12*** | (2006.01) |

(52) U.S. Cl.

CPC ..... *F25D 31/002* (2013.01); *F25D 23/126* (2013.01)

(58) Field of Classification Search

CPC ..... F25C 1/00; F25D 31/002; F25D 23/126; A23G 9/12; B67D 1/0857

USPC ..... 62/66, 393, 389, 342, 177; 222/146.6

See application file for complete search history.

(56) References Cited

U.S. PATENT DOCUMENTS 1,943,279 A * 1/1934 Max ..... 62/143
1,965,836 A 7/1934 Wilfrid (Continued)

FOREIGN PATENT DOCUMENTS

EP 0244031 11/1987
EP 1906120 4/2008

(Continued)

OTHER PUBLICATIONS

International Search Report for PCT/EP2009/006865, dated Nov. 6, 2009, 3 pages.

*Primary Examiner* — Mohammad M Ali

(74) *Attorney, Agent, or Firm* — Pearne & Gordon LLP

(57) ABSTRACT

The invention relates to a beverage cooler having an in-line operating cooling unit for instant cooling of beverage flowing through the same, comprising a cooling container (5) having an inlet (10) and an outlet (11), for feeding the beverage to and from the cooling container, respectively, and a cooling tube (14) located inside the cooling container. The cooling container (5) is adapted to be located in an ambient temperature which is above the freezing point for the beverage, wherein the cooling tube (14) is adapted to carry a cooling fluid having a temperature below the freezing point of the beverage and is located such that the beverage can pass between the cooling tube and an outer wall of the cooling container (5). Hence, the beverage will pass by the cooling tube and be cooled from it and freeze to solid phase in the area closest to the cooling tube, whereas the outside of the cooling container, having a temperature above the freezing point of the beverage, will ensure a free passage of non-frozen beverage closest to the outside wall of the cooling container.

21 Claims, 8 Drawing Sheets

(56) References Cited

U.S. PATENT DOCUMENTS

| | | | | | |
|---|---|---|---|---|---|
| 1,982,789 | A | * | 12/1934 | Gordon | 62/59 |
| 2,021,368 | A | * | 11/1935 | Martin | 62/306 |
| 2,069,374 | A | * | 2/1937 | Lagomarsino | 62/298 |
| 2,085,274 | A | * | 6/1937 | Rutt et al. | 222/131 |
| 2,098,211 | A | * | 11/1937 | Schulse | 165/135 |
| 2,177,207 | A | * | 10/1939 | Del Nero | 62/394 |
| 2,506,840 | A | | 5/1950 | Baudilio | |
| 2,647,734 | A | * | 8/1953 | Nicholas | 261/19 |
| 2,763,994 | A | | 9/1956 | Chandler | |
| 3,263,442 | A | * | 8/1966 | Timmersman | 62/394 |
| 3,441,176 | A | * | 4/1969 | Reynolds et al. | 222/640 |
| 3,469,415 | A | * | 9/1969 | Cornelius | 62/394 |
| 3,676,910 | A | * | 7/1972 | Gross | 29/727 |
| 3,696,636 | A | * | 10/1972 | Mille | 62/399 |
| 3,949,903 | A | * | 4/1976 | Benasutti et al. | 222/129.2 |
| 4,462,220 | A | * | 7/1984 | Iannelli | 62/201 |
| 4,723,688 | A | * | 2/1988 | Munoz | 222/88 |
| 4,866,949 | A | | 9/1989 | Rudick | |
| 4,979,647 | A | * | 12/1990 | Hassell | 222/146.6 |
| 5,249,710 | A | * | 10/1993 | Hassell et al. | 222/146.6 |
| 5,365,750 | A | * | 11/1994 | Greenthal | 62/293 |
| 5,671,604 | A | * | 9/1997 | Rudick | 62/52.1 |
| 5,799,726 | A | * | 9/1998 | Frank | 165/156 |
| 6,301,918 | B1 | * | 10/2001 | Quartarone et al. | 62/342 |
| 6,622,510 | B2 | * | 9/2003 | Giroux et al. | 62/342 |
| 6,830,239 | B1 | * | 12/2004 | Weber et al. | 261/121.1 |
| 6,981,387 | B1 | * | 1/2006 | Morgan | 62/390 |
| 7,131,560 | B2 | * | 11/2006 | Hammond | 222/399 |
| 7,717,166 | B2 | * | 5/2010 | Buchanan | 165/184 |
| 2004/0129723 | A1 | * | 7/2004 | Meder et al. | 222/113 |
| 2007/0084233 | A1 | * | 4/2007 | Kett et al. | 62/389 |

FOREIGN PATENT DOCUMENTS

| | | |
|---|---|---|
| EP | 1974802 | 10/2008 |
| JP | 2004163039 | 6/2004 |
| KR | 1020050030351 | 3/2005 |

* cited by examiner

BEVERAGE COOLER, A REFRIGERATOR COMPRISING SUCH A BEVERAGE COOLER AND A METHOD FOR COOLING BEVERAGE

The present invention relates to a beverage cooler having an in-line operating cooling unit for instant cooling of beverage flowing through the same, comprising a cooling container having an inlet pipe and an outlet pipe for feeding the beverage to and from the cooling container, respectively, and a cooling tube located inside the cooling container. The beverage cooler can either be built into a refrigerator, for home use or for commercial use, or be formed as a self-contained unit.

The invention also relates to a refrigerator comprising a beverage cooler as well as a method for cooling beverage.

BACKGROUND OF THE INVENTION

Cool drink dispensers or beverage coolers are known since long time. Inter alia, it is known to provide refrigerators with a water tank, being connected to a water supply pipe, for cooling of the water in the tank and, on command, dispense cool water through a dispenser built-in in the door of the fresh-food compartment. The refrigerator can also be provided with a second tank for adding carbon dioxide to the water to allow dispensing of sparkling water through the dispenser. There are several disadvantages with a cool drink dispenser of this kind. For example, it is bulky, a relatively long time is needed for restoring the cooling temperature of the water after the tank or tanks have been partly or completely emptied and refilled again, and there could be a risk for formation of mould and bacteria in case the dispenser is used only sporadic and the water is stored for long time in the tanks.

To overcome these drawbacks, the present applicant has developed a novel cool drink dispenser, as presented in EP1974802A1. This cool drink dispenser comprises an in-line operating cooling unit connected to a supply source for beverage, typically water. In one embodiment the cooling unit comprises a cooling pipe, through which the beverage flows, and heat accumulating material, such as paraffin or any other similar material surrounding the cooling pipe, absorbs heat from the beverage so as to cool the beverage to a predetermined temperature. To maintain the solid state of the heat accumulating material inside the tubular member, the cooling unit also comprises a cooling circuit, which is located in the heat accumulating material and through which a cooling fluid, such as cold air or any other gaseous or liquid cooling fluid is circulated. The cooling fluid can be cooled inside a freezer compartment of a refrigerator. The cooling circuit can also be formed as an evaporator containing a refrigerant.

In a second embodiment the cooling unit does not comprise the internal cooling pipe. Instead, the cooling unit comprises a tubular body into which the beverage is fed. The tubular body comprises cooling means, which cools the beverage inside the tubular body such that the beverage will freeze to a semisolid, high-viscosity mixture of frozen beverage. By controlling the cooling means in a suitable way, it is possible to limit the percentage of beverage in the solid or semisolid mixture state to not exceed a predetermined maximum ranging between 50% and 90% of the maximum capacity of the tubular body. In this way it is possible to ensure free circulation of beverage inside the tubular body through the solid or semisolid frozen beverage, such that beverage at ambient temperature can mix with and partly melt the solid or semisolid frozen beverage mixture and flow immediately to a dispenser valve where it can be dispensed to a user. In one embodiment the cooling means is formed as a housing surrounding the tubular body and comprises electric fans, which on command can circulate a stream of cold air at a temperature below a freezing temperature for the beverage or a stream of warm air at a temperature above the freezing temperature. The cold air stream can be taken from a freezer compartment of a refrigerator, typically holding a temperature of between −25° C. and 0° C., whereas the warm air stream may be taken from a fresh-food compartment of the refrigerator, typically holding a temperature of between 0° C. and 15° C.

However, a cool drink dispenser according to EP1974802A1 has some disadvantages. In order to prevent completely freezing of the beverage inside and maintain a free passage for the beverage through the cooling unit, it may be necessary to arrange heating elements, which can melt the frozen beverage when necessary. This will result in additional costs for the equipment and the introduction of a device that counteracts with the refrigeration process and thus may lead to increased power consumption. The above described second embodiment also necessitates the arrangement of a dedicated compartment in form of a housing surrounding the tubular body, which results in that the occupied space will increase. It also necessitates a precise sensing system for the formation of frozen beverage but prevent completely freezing of the beverage.

In an additional filed European patent application, EP1906120A1 from the present applicant, is disclosed an alternative appliance for supplying cooled water or other beverage. This appliance comprises an airtight tank for temporarily storing the beverage and the tank is connected to a source, which supplies beverage continuously to the tank. I.e. as soon as cooled beverage is dispensed from the tank, the source supplies fresh, warm beverage to the tank such that it always will be completely filled by beverage. The tank is either made of elastically deformable material or is a rigid container housing a closed capsule made of elastically deformable material and filled with gas. In one embodiment, the tank is accommodated inside a cooling compartment, e.g. formed in a door of a refrigerator. In order to control the temperature of the beverage inside the tank within a desired temperature range, the appliance comprises a number of electric fans which, on command, circulate inside the cooling compartment a stream of cold air, e.g. taken from a freezer compartment inside the refrigerator, or a stream of warm air, e.g. taken from a fresh food compartment in the refrigerator or from outside of the refrigerator. In this way the beverage inside the tank can be maintained at around the freezing temperature. Alternatively, the fans may be replaced by an evaporator inside the cooling compartment. One disadvantage with such an appliance is that the control device for regulating the temperature of the beverage inside the tank will be relatively complicated in order to maintain the temperature as close as possible to the freezing point and yet prevent completely freezing of the beverage and blocking of the tank, which would make it impossible to dispense beverage. Such a regulating including alternate warming and cooling could also lead to increased energy consumption. Another disadvantage associated with such an appliance is that it will require a relatively large space since the tank has to be enclosed by a cooling compartment to allow circulation of warm or cold air around the tank. In another embodiment, the tank is so designed that, even if ice is formed therein, it can expand in a radial direction when there is a sufficient pressure of liquid at its entrance, so as to allow liquid flow. Moreover, the tank may be designed such that some portions of the tank are positioned inside a cooling compartment while others are outside of the cooling compartment.

U.S. Pat. No. 4,866,949 B1 discloses a system for dispensing a chilled, carbonated water or beverage from a conventional home refrigerator. The beverage to be chilled and carbonated is held in a receptacle, the carbonator, having inlet and outlet for the beverage. A coiled evaporator either surrounds or is located inside the receptacle for cooling beverage therein. The beverage level in the receptacle is kept at a predetermined level by a float mechanism extending down in the receptacle leaving a $CO_2$ pocket within the receptacle. A disadvantage with the system described in U.S. Pat. No. 4,866,949 B1 is that it is constructed for dispensing carbonated beverage only and not for dispensing also chilled non-carbonated beverages.

SUMMARY OF THE INVENTION

It is an object of the invention to improve in-line operating beverage coolers. More precisely it is an object to provide an in-line operating beverage cooler, which is space-saving and has a simple and inexpensive structure. At least this object is achieved by a beverage cooler according to claim 1.

The invention also relates to a refrigerator provided with an in-line operating beverage cooler and a method for cooling beverage having essentially the same object as above. At least this object is achieved by a refrigerator according to claim 17 and a method according to claim 18.

Accordingly, the basis of the invention is the insight that at least the above object may be achieved by providing a cooling container having an inlet and an outlet for allowing the beverage to flow through the container, and a cooling tube that is arranged inside the cooling container and through which a cooling fluid can be circulated. The cooling container is adapted to be positioned in an ambient temperature above the freezing point for the beverage, whereas the cooling fluid, circulated inside the cooling tube, is adapted to have a temperature which is below the freezing point for the beverage. In this way, when it is desirable to dispense cold beverage for drinking, the beverage is present between the cooling tube and an outer wall of the cooling container and can flow through the cooling container and pass by the cooling tube such that the beverage will be instantly cooled by the cooling fluid inside the cooling tube. Eventually, there will be formed a layer of frozen beverage around the cooling tube, whereas a free passage of non-frozen beverage always will be present in an area closest to a peripheral wall of the cooling container due to the ambient temperature being above the freezing point for the beverage. The cooling container is adapted to be completely filled with frozen and unfrozen beverage. Thus, there is no air pocket present in the cooling container. An advantage with this system having no trapped air or air pockets in the cooling container is that bacteria growth is prevented. Accordingly, the hygienic aspects of this system are improved. When a layer of frozen beverage is formed around the cooling tube, the frozen beverage will partly melt when warm beverage flows around the cooling tube as beverage is dispensed from the cooling unit. Accordingly, the frozen beverage around the cooling tube represents a cooling supply, which will contribute to the instant cooling of the beverage as it flows through the cooling container from the inlet to the outlet. Utilizing frozen beverage for cooling the warm beverage is advantage since a large amount of energy is required for transforming a substance in solid phase into liquid phase. Since the cooling container is located in an ambient temperature above the freezing point of the beverage, no heating means is required to ensure a free passage of non-frozen beverage through the cooling container. To have the best effect out of the system it may be around 60% to 99% of frozen beverage in the cooling container. More specific, the amount of frozen beverage may vary between 85% to 95%.

By a proper adaptation of the cooling effect to the size of the cooling container and the ambient temperature around it, it would be possible to find a proper balance which always will ensure a free passage of non-frozen beverage through the cooling container regardless of whether beverage is dispensed through the cooler during an extended time period or not. However, it can be advisably to provide some kind of regulating device to control the throughput of cooling fluid through the cooling tube, in order to restrict or interrupt the cooling effect when no beverage is dispensed from the cooling unit and to increase the cooling effect when an amount of beverage is dispensed. It would also be possible to arrange e.g. a fan to increase the air flow around the cooling container in case the beverage inside is in the risk of becoming completely frozen.

Within this overall idea, the invention can be realized in many different embodiments. The beverage normally being cooled in a cooler according to the invention is water and in that case the cooling unit preferably is connected to a water supply conduit, e.g. a conduit of a mains water network. However, it would also be conceivably to cool also other types of beverages with a cooler according to the invention, such as e.g. juice.

Moreover, the cooler according to the invention, can be arranged in a refrigerator having a freezer compartment, with a temperature typically ranging between 0° C. and −25° C., and a fresh food compartment with a temperature typically ranging between 0° C. and 15° C. In this way the advantage is achieved that many of the means, which already is present in the refrigerator, can be utilized for realizing the invention. For example, the cooling container can be positioned in the fresh food compartment, which holds a temperature above the freezing point for water and the temperature is moreover essentially uniform and low which facilitates regulating and eliminates the need for any insulation around the cooling container. Additionally, the freezer compartment can be utilized for cooling the beverage inside the cooling container, e.g. by transferring cold air from the freezer compartment through the cooling tube inside the cooling container. Alternatively, it would be conceivable to arrange the cooling tube as part of a closed loop filled with a cooling fluid, such as for example water having an anti-freezing additive in form of e.g. salt, alcohol or glycol or a gaseous cooling fluid, and to circulate the cooling fluid through the freezer compartment, for cooling of the cooling fluid, and through the cooling container for absorbing heat from the beverage. Another possibility is to cool the inside of the cooling tube by using a thermosyphone or a heat pipe, in which a suitable refrigerant, in a loop or a single pipe, is made to evaporate inside the cooling tube. The condenser of the heat pipe or thermosyphone could favourably be cooled by being in thermal contact with the evaporator of the refrigerator. The condenser of the thermosyphone or the heat pipe could also be cooled by an alternative means of refrigeration, such as for instance a thermoelectric refrigeration unit.

A possible way for regulation of the temperature in the cooling tube may be performed in different ways, such as e.g. by measuring the temperature inside the cooling container a small distance from the cooling tube and to regulate a fan or a pump, which circulates the cooling fluid through the cooling tube. In an alternative embodiment the fan or the pump may be dispensed with if measures are taken to provide self-circulation of the cooling fluid from the freezer compartment to the cooling container and back again. In such a case, the regulating device may comprise a throttle valve, which controls the circulation of the cooling fluid.

Instead of combining the cooling unit with a conventional refrigerator having a fresh food compartment as well as a freezer compartment, it would be conceivable to combine it with a pure freezer if the cooling container is positioned outside of the actual freezer compartment, such as completely outside of the freezer or in a dedicated space inside a door or a wall of the freezer having a temperature above the freezing point. It is also possible, as in a hereinafter described and illustrated embodiment, to combine the cooling unit with a refrigerator having only a fresh food compartment by letting the refrigerant of the refrigerator cooling system circulate also through the cooling tube.

In another embodiment of the invention, the cooling container comprises a housing wherein one end of the housing is provided with the inlet and the outlet for feeding the beverage to and from the cooling container, respectively. An advantage with this construction is a simple and cost effective construction of the cooling container.

In another embodiment of the invention, the cooling tube is formed with one or more loops within the cooling container. In this way an effective cooling is achieved as the build-up of a core of frozen beverage around the cooling tube is fast. A further advantage is a simple and cost effective construction of the cooling tube.

It would also be possible to form the beverage cooler as a completely self-contained unit. In such a case it is necessary to provide the beverage cooler with a refrigeration unit comprising for example a compressor and a condenser or alternative means of refrigeration such as thermoelectric cooling, thermionic cooling, magnetic refrigeration, thermoacoustic cooling, absorption cooling and adsorption cooling. If the cooling container is located in room temperature, it is advisable to provide it with an insulating layer to reduce heat absorption in the cooling container from the outside.

In order to increase the cooling effect, the cooling tube can be provided with cooling flanges. In the described and illustrated further embodiments, the cooling tube is provided with a cooling flange, which is spirally wound around the cooling tube and extends the entire distance between the outer surface of the cooling tube and the peripheral wall of the cooling container. In this way is formed a long, narrow and spirally shaped path for the beverage to flow between the inlet and the outlet. Due to this is achieved an extremely effective cooling of the beverage, since the flow path is so long, the area of exposure to cold surfaces is so large and the flow through the cooling tube will be entirely turbulent, due to the high flow speed and the proximity to surrounding walls everywhere in the cooling container. To increase the turbulent flow, the surfaces of the cooling flange can be provided with irregularities. Also in these embodiments it is advantageous if the beverage closest to the cooling tube is frozen to ice, whereas a passage of unfrozen beverage is maintained at the peripheral walls. Naturally, the invention can be modified also in many other ways within the scope of the claims. It is preferred that the cooling tube is located centrally inside the cooling container, preferably concentric with the cooling container. This is advantageous in that the formation of a layer of frozen beverage can occur around the entire cooling tube and a free passage of non-frozen beverage may be maintained closest to the entire inner surface of the cooling container. However, it would also be possible to position the cooling tube adjacent a portion of the inner surface of the cooling container. Important is however that the outer cross sectional dimension of the cooling tube is sufficient smaller than the inner cross sectional dimension of the cooling container such that a free passage of non-frozen beverage always may be maintained somewhere in the cooling container. Generally, it is preferred to form the cooling tube as well as the cooling container with a circular cross section but also other cross sectional shapes would be conceivable. To increase the cooling capacity of the cooling tube, it can be provided with cooling flanges or the like around its periphery.

A beverage cooler according to the invention, can be combined with a refrigerator in many different ways, such as a refrigerator comprising a fresh food compartment and a freezer compartment, wherein the cooling container is positioned in the fresh food compartment or outside it, for example in the back or in a wall of the refrigerator and the cooling fluid in the cooling tube is cooled in the freezer compartment. As already mentioned, the beverage cooler can also be combined with a pure freezer if the cooling container is positioned outside of the freezer or in a dedicated space inside the door, in a wall or the like. In case the refrigerator do not contain any freezer compartment but only a fresh food compartment, it is possible to position the cooling container inside the fresh food compartment and let the evaporator of the refrigerator, or a branching from it, constitute the cooling tube.

Naturally, it is also conceivable to combine the beverage cooler with a carbonation device for mixing carbon dioxide into the beverage, e.g. a carbonation device as disclosed in EP1974802A1 or any other suitable kind, to obtain a sparkling beverage.

BRIEF DESCRIPTION OF THE DRAWINGS

An exemplary embodiment of the invention will hereinafter be described with reference to the accompanying drawings, in which.

DETAILED DESCRIPTION OF AN EMBODIMENT OF THE INVENTION

Figure 1:
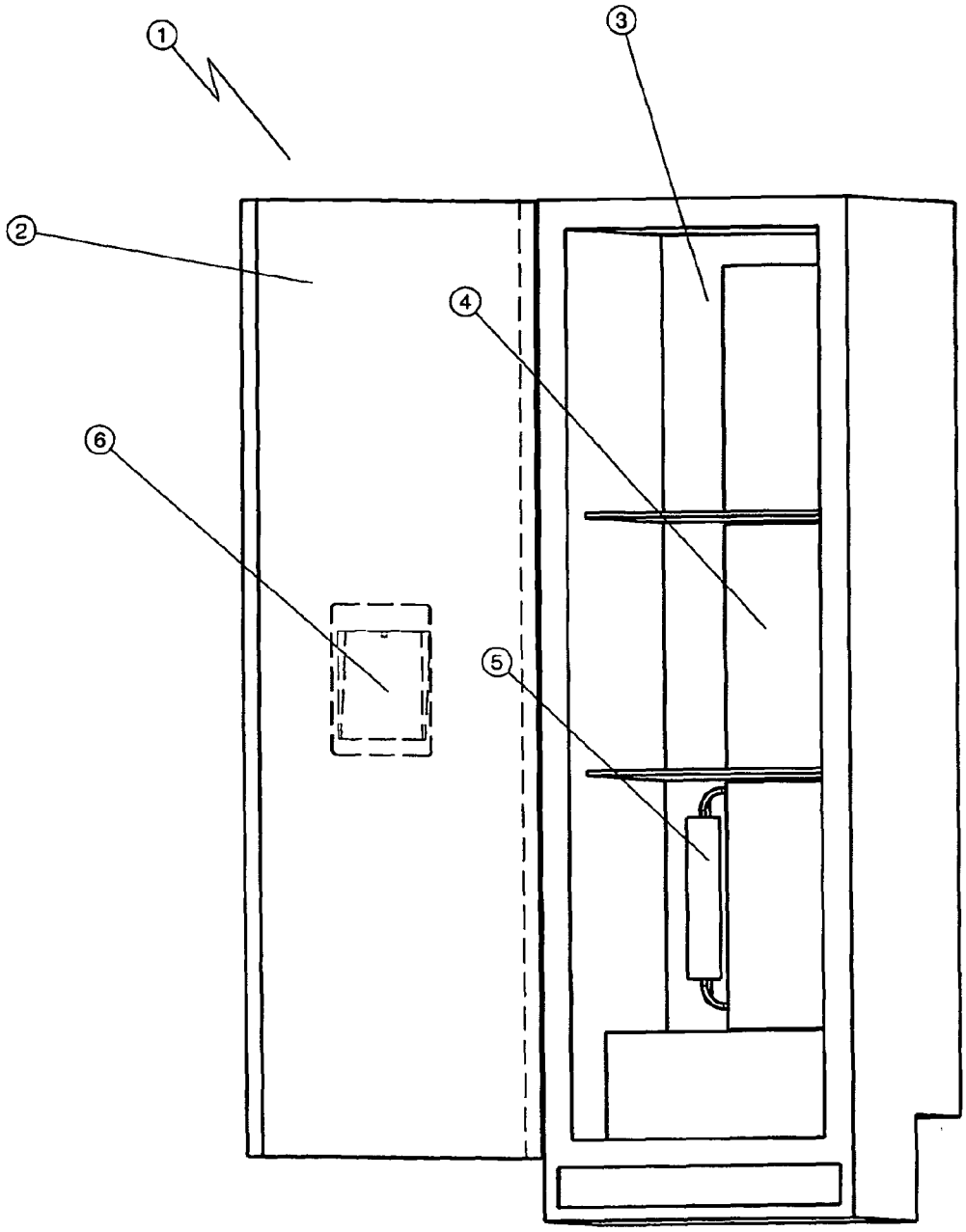
FIG. 1 is a schematic perspective view of a refrigerator being provided with a beverage cooler according to the invention.

In FIG. 1 is illustrated a refrigerator 1 of which a door 2 is open for visibility of the interior of the refrigerator. The refrigerator is in this embodiment of the type having only a fresh food compartment 3, which has a temperature ranging normally between 0° C. and about 8° C. Inside the fresh food compartment, the refrigerator is provided with cooling radiators 4, through which a refrigerant is circulated in a conventional way known in the art, for cooling of the fresh food compartment. Also positioned inside the fresh food compartment is a cooling container 5 of a beverage cooler, according to the invention, and on the outer surface of the door is provided a recess 6, indicated with broken lines on the inside of the door in FIG. 1, which contains a not shown beverage dispenser unit for dispensing cooled beverage to a user when desired. However, it is to be understood that the cooling container 5 of a beverage cooler may be positioned at the back or in a wall of the refrigerator, i.e. outside the fresh food compartment.

Figure 2:
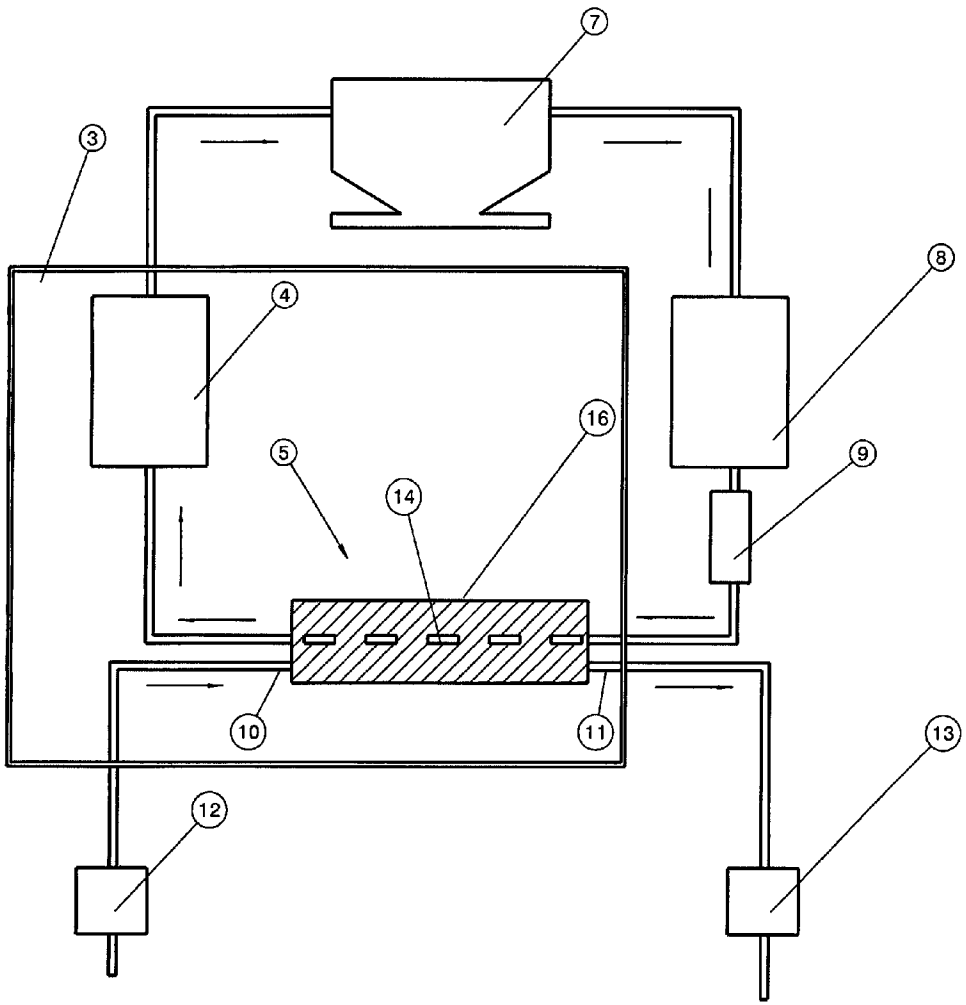
FIG. 2 is a schematic presentation of components of the cooling system for the refrigerator and beverage cooler according to FIG. 1 in form of a functional block diagram.

Reference is then made to FIG. 2 in which the essential structure of the refrigerator cooling system and the beverage cooler is illustrated in form of a block circuit diagram. The fresh food compartment 3 of the refrigerator is indicated by a rectangle. The refrigerator cooling system comprises a compressor 7, which is positioned outside of the fresh food compartment. In the compressor, a gaseous refrigerant fluid is compressed, which has to result that the temperature of the refrigerant is increased. The refrigerant is then passed through a condenser 8 where the warm gas is cooled and condensed to a liquid phase. The liquid refrigerant then flows through an expansion valve 9 where the pressure is lowered. This has to result that the liquid refrigerant at least partly will return to a gaseous state. The conversion of the refrigerant from liquid phase to gaseous phase will lower the temperature of the refrigerant considerably. Immediately after passing the expansion valve, the refrigerant passes the wall of the refrigerator cabinet and flows into the cooling container 5 of the beverage cooler according to the invention.

The cooling container 5 is provided with an inlet 10 and an outlet 11 to admit filling and discharging of beverage to be cooled into and from the cooling container, respectively. In the embodiment illustrated, the beverage to be cooled is water, so for this reason the beverage inlet is connected to a water mains network at a water net connection 12. The outlet is connected to the water dispenser unit 13 in the outer surface of the door. However, it is to be understood that also other kinds of beverages could be cooled by means of the beverage cooler according to the invention. In that case the inlet tube is connected to a container containing the beverage instead of being connected to the water mains network. To achieve cooling of the beverage, a cooling tube 14 is extended through the cooling container through which the refrigerant flows, i.e. the cooling tube functions in this embodiment as an evaporator, which cools the beverage flowing around it.

The cooling tube is connected in series with the evaporator in form of the cooling radiators 4 of the refrigerator cooling system, which can be of a generally known type comprising additionally valves, sensors, control equipment, cooling flanges and the like, so as to accomplish cooling of the inside air of the fresh food compartment 3 in a desired degree.

Figure 3:
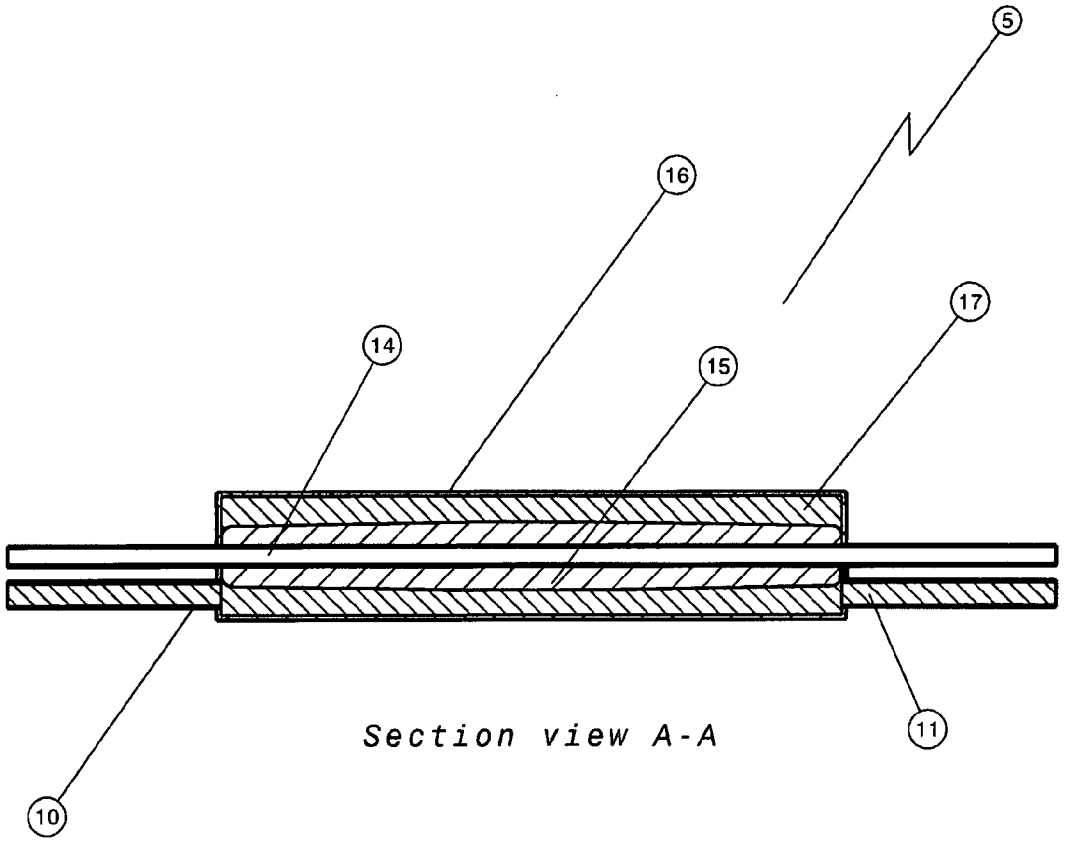
FIG. 3 is an enlarged section through a cooling container of the beverage cooler.

Referring thereafter to FIG. 3, in which a first embodiment of the cooling container 5 is illustrated in a longitudinal section. As is apparent, the cooling tube 14 is positioned centrally in the cooling container 5 and extends completely there through. In a practical embodiment, the cooling tube 14 can preferably be formed with cooling flanges and the like for increased cooling capacity. During operation the cooling container 5 is completely filled with beverage from inlet 10 and it is most likely, and also desirable, that a layer of frozen beverage will be formed in the region closest to the cooling tube 14, as is illustrated by the layer 15 in FIG. 3. However, in the region closest to peripheral walls 16 of the cooling container, it is intended that the beverage will be maintained in an unfrozen state, as is indicated at 17. In this way a passage of unfrozen beverage is formed such that warm beverage may flow in through the inlet 10, be cooled by the refrigerant circulating through the cooling tube 14 and the frozen beverage 15 around the cooling tube and flow out in form of cooled beverage through the outlet 11.

As the beverage cooler is allowed to form frozen beverage around the cooling tube, the further advantage is achieved that the cooling container 5 will contain stored cooling capacity in form of frozen beverage, which can be made use of when warm beverage is flowing in through the inlet in order to achieve instant cooling of the beverage. In use, the cooling container 5 is always completely filled with frozen 15 and unfrozen beverage 17. There are no air pockets in the cooling container 5 and thus no air is in direct contact with the beverage in the cooling container. A control device for regulating the cooling effect of the cooling container may in a simple embodiment comprise a temperature sensor located in the passage 17 of unfrozen beverage in the cooling container, which by means of a control circuit regulates the pressure drop in the expansion valve 9 and hence the cooling effect of the cooling tube 14. For example, the control device may be set to maintain the temperature of the unfrozen beverage 17 one or a few degrees above the freezing point for the beverage. To have the best effect out of the system it may be around 60% to 99% of frozen beverage in the cooling container. More specific, the amount of frozen beverage may vary between 85% to 95%.

A further control device is also arranged in relation to the beverage cooler to handle the overpressure created within the cooling container 5 due to the formation of ice therein, i.e. frozen beverage. One solution to this problem is to install an overpressure valve (not shown) that releases an amount of beverage equal to the expanded volume due to ice formation. The valve may be arranged on the cooling container 5, the inlet 10 or the outlet 11, or at any other point where there is open communication with unfrozen beverage. The beverage is drained to a drainage receptacle of the cooling appliance, i.e. refrigerator or freezer. Another solution to handle the overpressure may be to arrange an overpressure balloon for equalizing pressure in the system or to use flexible tubings that could slightly expand as pressure increases in the system.

Figure 4:
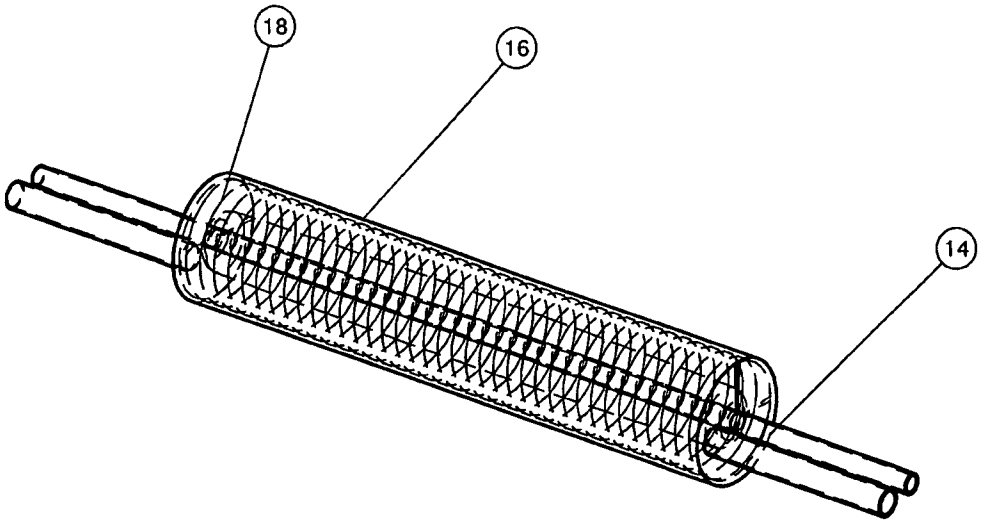
FIG. 4 is an enlarged transparent perspective view of an alternative embodiment of the cooling container.
Figure 5:
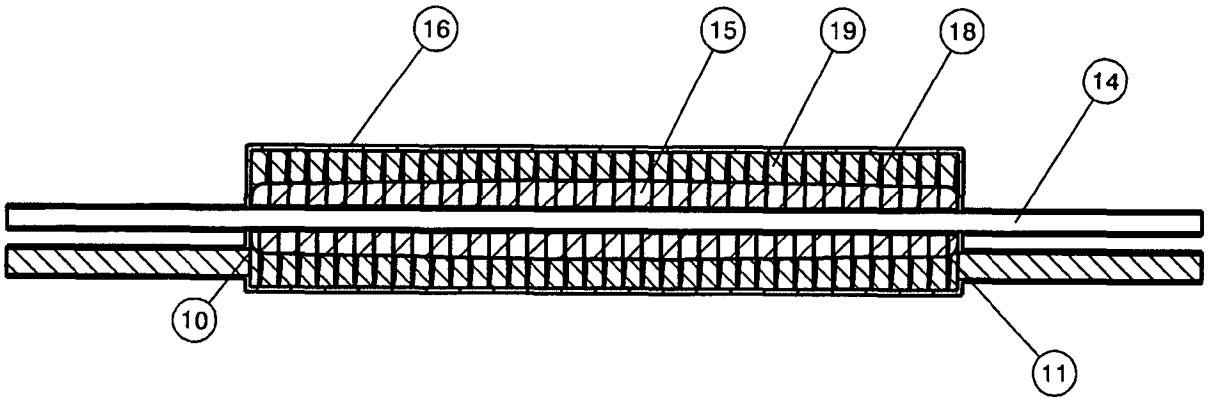
FIG. 5 is a longitudinal section of the cooling container in FIG. 4.

Reference is then made to FIGS. 4 and 5 of the drawings, in which a second embodiment is illustrated in a transparent perspective view in FIG. 4 and a longitudinal section in FIG. 5. In this embodiment, the cooling tube 14 is provided with a cooling flange 18. However, this cooling flange does not extend only a short distance above the outer surface of the cooling tube, as is customary in connexion with cooling and heating appliances. Instead, the cooling flange is spirally wound around the cooling tube 14 and extends the entire distance between the outer surface of the cooling tube and the peripheral wall 16. In this way is formed a long, narrow and spirally shaped path 19 for the beverage to flow between the inlet 10 and the outlet 11. Due to this is achieved an extremely effective cooling of the beverage, since the flow path is so long, the area of exposure to cold surfaces is so large and the flow through the cooling tube will be entirely turbulent, due to the high flow speed and the proximity to surrounding walls everywhere in the cooling container. Also in this embodiment it is advantageous if the beverage closest to the cooling tube is frozen to ice 15, whereas a passage of unfrozen beverage is maintained at the peripheral walls 16.

Figures 6A, 6B, 6C:
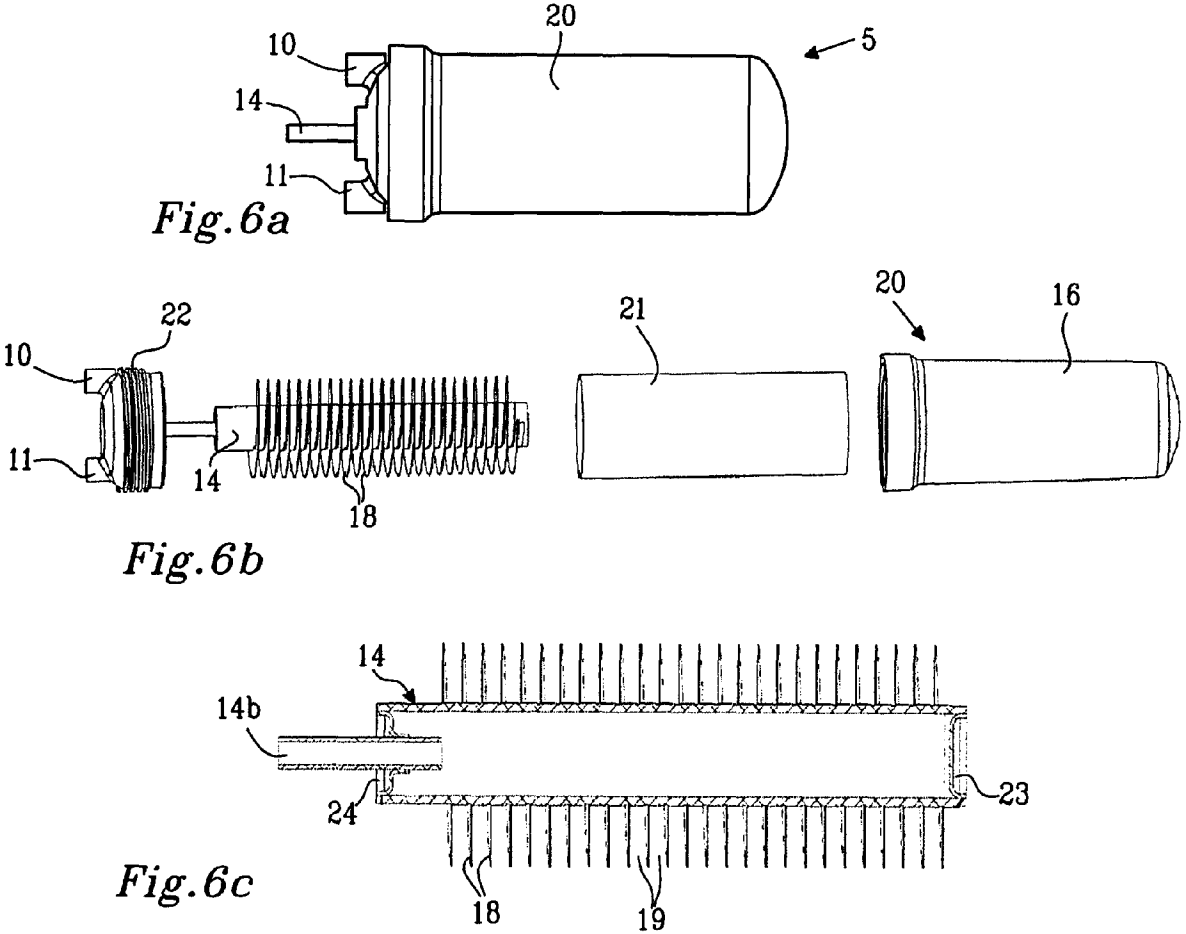
FIG. 6*a* illustrates a further alternative embodiment of the cooling container in which the cooling tube is arranged.
FIG. 6*b* is an exploded view of the cooling container in FIG. 6*a*.
FIG. 6*c* is a cross-sectional view of the cooling tube in FIG. 6*b*.

In FIG. 6*a* another embodiment of the cooling container 5 is illustrated. In this embodiment, the cooling container 5 comprises a housing 20 for holding the cooling tube 14 inside. One end of the housing 20 is provided with the inlet 10 and the outlet 11 for feeding the beverage to and from the cooling container, respectively. The opposite end of the housing is a closed end. In FIG. 6*b*, the different parts of the cooling container 5 are shown. The cooling container 5 comprises the housing 20 having a peripheral wall 16, a cooling tube 14 provided with flanges 18, an inner tube 21 and an end piece 22. The inner tube 21 forces the beverage to be cooled to flow between the cooling tube 14 and the inner tube 21. The inner tube 21 further separates the incoming beverage to be cooled from the outgoing cooled beverage, such that the incoming beverage to be cooled flows between the cooling tube 14 and inner tube 21 while the outgoing cooled beverage flows between the inner tube 21 and the peripheral wall 16 of the cooling container 5. The end piece 22 is adapted to be connected to the housing 20 by means of for example screw shreds, welding or snap fit coupling for closing the cooling container 5. The end piece 22 is further provided with the inlet opening 10 for receiving beverage to be cooled and the outlet opening 11 through which the cooled beverage is transported to be dispensed.

FIG. 6*c* shows a cross-sectional view of the cooling tube 14 in FIG. 6*b*. The cooling tube 14 is provided with flanges 18 arranged as a spiral around the outer periphery of the tube. The pitch of the spiral is chosen to satisfy the desired flow and effect of the cooler. In one embodiment the pitch may be approximately between 2,5 to 10 mm per revolution. In this way a spirally shaped path 19 is provided between the flanges 18 through which path 19 the beverage to be cooled is flowing. The spiral flange 18 is fixed to the tube 14. An end plug 23 is arranged at one end of the tube providing a closed structure for holding the cooling fluid. The cooling fluid enters and exits the tube 14 through an end plug bushing 24. The cooling tube 14 should endure pressure up to 20 bars. In the embodiment shown in FIG. 6*c* a suction pipe 14*b* forms the exit or outlet for cooling fluid to the cooling tube 14. In this embodiment, an inlet 14*a* (not shown) for the cooling liquid to the cooling tube is arranged within the outlet 14*b* of the cooling tube 14. The cooling tube 14 and its flanges 18 are preferably made out of a metallic material.

Figure 7B:
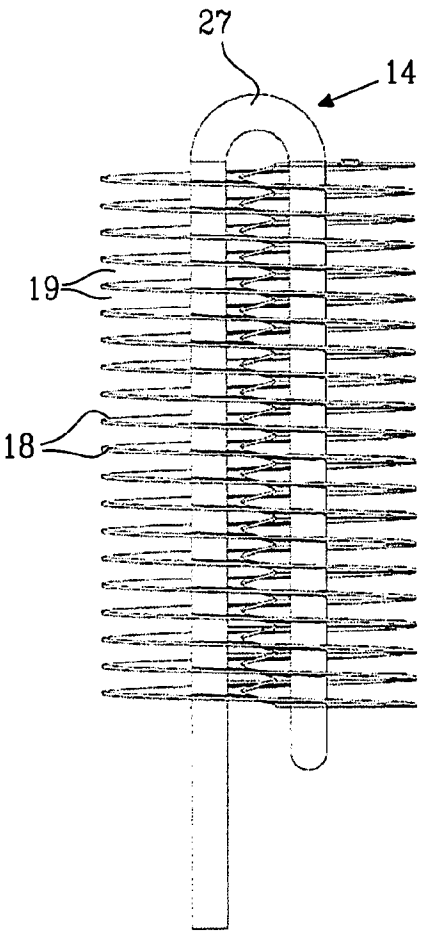
FIG. 7*a-b* illustrates another embodiment of the cooling tube to be arranged in the cooling container of FIG. 6*a*.
Figure 7A:
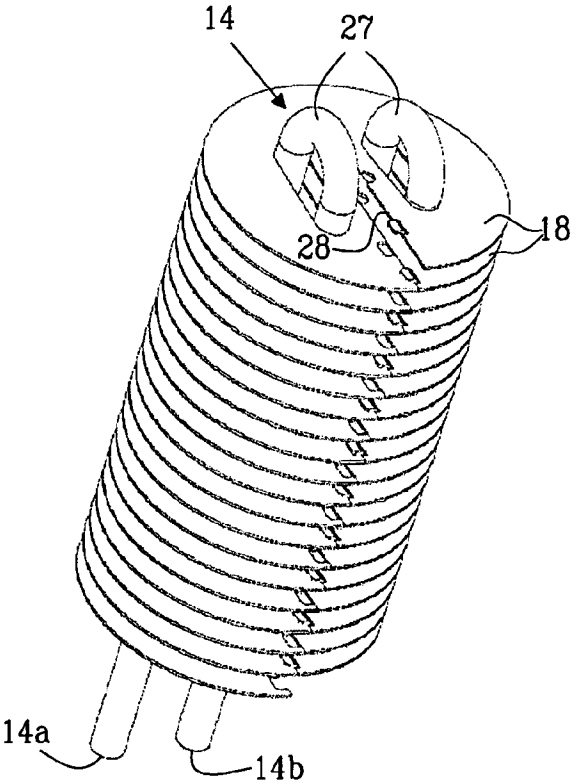

In FIG. 7*a* another embodiment of the cooling tube 14 is illustrated. In this embodiment the cooling tube 14 is arranged in at least one loop within the cooling container 5. In FIG. 7*a* an embodiment is shown where four tube elements are provided and to which three U-formed end members 27 are attached in forming the cooling tube 14. In this way the cooling tube 14 is formed with one or more loops within the cooling container 5. The cooling tube 14 is provided with flanges 18 arranged as a spiral around the cooling tube. In this embodiment the spiral pattern of the flanges 18 are provided by circular shaped discs. The spiral shape is formed as one disc is attached to another disc above or below itself via a radial slit 28 from the centre of the disc out to its periphery. The pitch of the spiral is decided by the bend-up distance in the radial slit 28. FIG. 7*b* shows a cross-sectional view of the cooling tube of FIG. 7*a*. In use the cooling fluid will flow through the cooling tube 14 and beverage that is present in the path 19 between the flanges 18 will freeze. A core of frozen beverage (not shown) will form around the cooling tube 14 and the path 19 will be reduced. However, the control function described above will see to that a path of unfrozen beverage is always present in the cooling container.

Figure 8B:
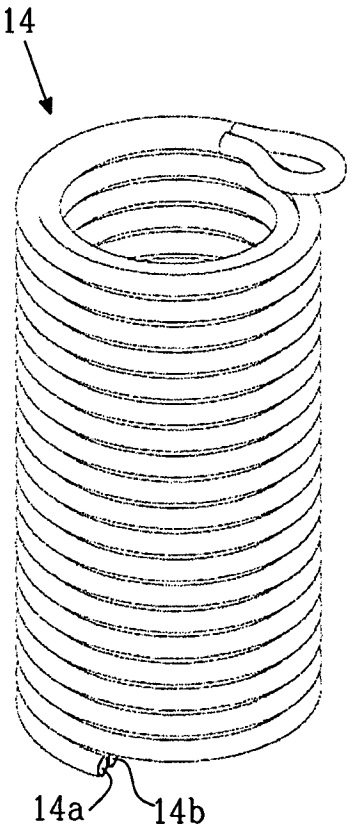
FIG. 8*a-b*. illustrates still another embodiment of the cooling tube to be arranged in the cooling container of FIG. 6*a*.
Figure 8A:
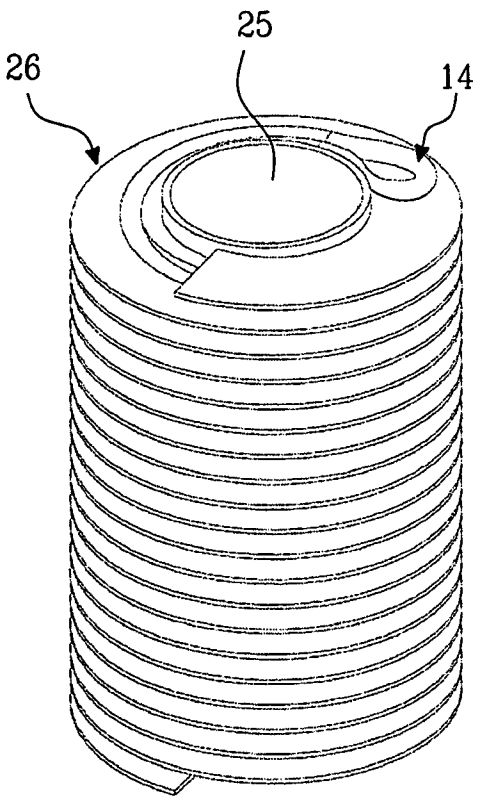

In FIG. 8*a* still another embodiment of the cooling tube 14 is illustrated. In this embodiment a tube 25 is arranged with flanges 26 on its outside. The flanges 26 are arranged in a spiral shape. The cooling tube 14 is arranged in the spirally formed space between the flanges 26 and the outer wall of the tube 25. The tube 25 and the flanges 26 may be provided in a polymeric material. The cooling tube 14 may be of a metallic material such as for example aluminum. In FIG. 8*b* the shape of the cooling tube 14 is shown. A tube is provided in a loop that is wound in a number of revolutions corresponding to the spiral flanges 26 of the tube 25. As in the other embodiments, a core of frozen beverage will be formed around the cooling tube 14 in between the flanges 26 and path of unfrozen beverage will be maintained between flanges 26.

The invention claimed is:

1. A beverage cooler having an in-line operating cooling unit for instant cooling of beverage flowing through the same, comprising a cooling container having an inlet and an outlet, for feeding the beverage to and from the cooling container, respectively, an inner tube located inside the cooling container, and a cooling tube extending through the inner tube, wherein the cooling container is adapted to be located in an ambient temperature which is above the freezing point for the beverage and the cooling tube is adapted to carry a cooling fluid having a temperature below the freezing point of the beverage and is located such that the beverage is present and can pass between the cooling tube and an outer wall of the cooling container, and wherein the cooling container is adapted to be, filled with frozen and unfrozen beverage such that the cooling container has no unfilled space, and wherein the inner tube is configured such that the beverage passing through the cooling container flows both through the inner tube and outside of the inner tube between the inner tube and the outer wall of the cooling tube.

2. The beverage cooler according to claim 1, wherein the cooling tube is located centrally within the cooling container.

3. The beverage cooler according to claim 1, further comprising a regulating device, which controls the cooling effect.

4. The beverage cooler according to claim 1, wherein the beverage cooler is positioned in a fresh food compartment of a refrigerator having a temperature above 0° C.

5. The beverage cooler according to claim 1, wherein the beverage cooler is positioned in a combined refrigerator having a fresh food compartment and a freezer compartment, wherein the cooling container is positioned in the fresh food compartment, whereas the cooling fluid is cooled in the freezer compartment.

6. The beverage cooler according to claim 5, wherein the cooling fluid is air which is taken from the freezer compartment.

7. The beverage cooler according to claim 6, wherein the cooling tube is formed as a closed loop and filled with a fluid, which is cooled in the freezer compartment.

8. The beverage cooler according to claim 1, wherein in use there will be formed a layer of frozen beverage around the cooling tube, whereas unfrozen beverage always will be present in an area closest to a peripheral wall of the cooling container.

9. The beverage cooler according to claim 1, wherein the cooling container comprises a housing wherein one end of the housing is provided with the inlet and the outlet for feeding the beverage to and from the cooling container, respectively.

10. The beverage cooler according to claim 9, wherein the cooling tube is formed with one or more loops within the cooling container.

11. The beverage cooler according to claim 1, wherein the cooling tube is in form of an evaporator in line with a compressor that forms part of a cooling system of a refrigerator.

12. The beverage cooler according to claim 1, wherein the beverage cooler is formed as a self contained unit.

13. The beverage cooler according to claim 1, wherein the cooling unit is combined with a carbonation unit.

14. The beverage cooler according to claim 1, wherein the cooling tube is in series with an evaporator of a refrigerator cooling system configured to cool the inside air of a fresh food compartment of a refrigerator.

15. The beverage cooler according to claim 1, further comprising a cooling flange spirally wound around the cooling tube, wherein the cooling flange extends the entire distance between an outer surface of the cooling tube and the outer wall of the cooling container.

16. The beverage cooler according to claim 1, wherein the cooling container is adapted to be filled with frozen and unfrozen beverage such that the beverage is in direct contact with the cooling tube and there is no air in direct contact with the frozen and unfrozen beverage in the cooling container.

17. The beverage cooler according to claim 1, further comprising a control device configured to control cooling of the beverage within the cooling container such that an amount of the beverage forms a layer of frozen beverage in direct contact with the cooling tube and another amount of the beverage near a peripheral wall of the cooling container is maintained in an unfrozen state.

18. A method for cooling beverage, comprising the steps of: providing a cooling container having an inlet and an outlet for the beverage to be cooled, an inner tube located inside the cooling container, and a cooling tube located extending through the inner tube; positioning the cooling container in an ambient temperature above the freezing point for the beverage; circulating a cooling fluid having a temperature below the freezing point for the beverage through the cooling tube; passing the beverage to be cooled through the cooling container such that the beverage fills the cooling container such that the cooling container has no unfilled space and the beverage flows by the cooling tube; passing the beverage through the container such that the beverage passing through the cooling container flows both through the inner tube and outside of the inner tube between the inner tube and the outer wall of the cooling container; and controlling the temperature and/or the flow rate of the cooling fluid through the cooling tube such that frozen beverage is accumulated around the cooling tube while a free passage of non-frozen beverage is maintained in an area closest to an outside wall of the cooling container (5).

19. The method according to claim 18, comprising the further step of:

arranging the cooling tube inside a fresh food compartment of a refrigerator having a temperature above O° C.

20. The method according to claim 18, comprising the further step of:

cooling the cooling fluid in the cooling tube by means of a freezer compartment of a refrigerator having a temperature below 0° C.

21. A beverage cooler having an in-line operating cooling unit for instant cooling of beverage flowing through the same, comprising a cooling container having an inlet and an outlet, for feeding the beverage to and from the cooling container, respectively, an inner tube located inside the cooling container, and a cooling tube extending through the inner tube, wherein the cooling container is adapted to be located in an ambient temperature which is above the freezing point for the beverage, wherein the cooling tube is adapted to carry a cooling fluid having a temperature below the freezing point of the beverage and is located such that the beverage is present and can pass between the cooling tube and an outer wall of the cooling container, and wherein the cooling container is adapted to be, filled with frozen and unfrozen beverage such that the cooling container has no unfilled space, wherein the cooling tube is adapted to contact the beverage and wherein the inner tube is configured such that the beverage passing through the cooling container flows both through the inner tube and outside of the inner tube between the inner tube and the outer wall of the cooling container.

* * * * *